US006763548B1

(12) United States Patent
Birle et al.

(10) Patent No.: US 6,763,548 B1
(45) Date of Patent: Jul. 20, 2004

(54) VACUUM CLEANER

(76) Inventors: Ruben Birle, 709 S. Agate St., Anaheim, CA (US) 92804; Victor Birle, 709 S. Agate St., Anaheim, CA (US) 92804

( * ) Notice: Subject to any disclaimer, the term of this patent is extended or adjusted under 35 U.S.C. 154(b) by 254 days.

(21) Appl. No.: 10/090,127

(22) Filed: Mar. 5, 2002

(51) Int. Cl.[7] ..... A47L 9/10
(52) U.S. Cl. ..... 15/351; 15/324; 15/DIG. 1
(58) Field of Search ..... 15/324, 351, 352, 15/354, DIG. 1; 55/DIG. 3

(56) References Cited

U.S. PATENT DOCUMENTS 4,835,409 A * 5/1989 Bhagwat et al. ..... 307/64
5,014,386 A * 5/1991 Worwag ..... 15/339
5,014,388 A * 5/1991 Schiazza et al. ..... 15/339
5,020,186 A * 6/1991 Lessig et al. ..... 15/339
5,134,752 A * 8/1992 Shipman ..... 15/412
6,260,235 B1 * 7/2001 Leung ..... 15/412
2002/0121000 A1 * 9/2002 Tyler ..... 15/412

* cited by examiner

*Primary Examiner*—Terrence R. Till
(74) *Attorney, Agent, or Firm*—Matthew J. Peirce

(57) ABSTRACT

A new and improved vacuum cleaner is disclosed which would be powered solely by battery means and/or self-generated power means. The vacuum cleaner would preferably be a standard push-type vacuum cleaner and would include a rechargeable battery which would be externally mounted. The vacuum cleaner would also have a top-mounted light which would face forward and assist a user in vacuuming. The light would be powered by a generator that would produce power when the wheels of the vacuum cleaner are turned.

5 Claims, 2 Drawing Sheets

VACUUM CLEANER

I. BACKGROUND OF THE INVENTION

The present invention concerns that of a new and improved vacuum cleaner which would be powered solely battery means and/or self-generated power means.

II. DESCRIPTION OF THE PRIOR ART

U.S. Pat. No. 5,020,186, issued to Lessig, III, discloses a vacuum cleaner that has a power brush which projects dirt particles directly into a specially formed and located vacuum nozzle in such a manner that low air consumption can be used.

U.S. Pat. No. 4,835,409, issued to Bhagwat et al. discloses a corded/cordless dual-mode power-operated device, such as a household vacuum cleaner, that can be operated from in corded mode or a cordless mode, depending on the power source.

III. SUMMARY OF THE INVENTION

The present invention concerns that of a new and improved vacuum cleaner which would be powered solely by battery means and/or self-generated power means. The vacuum cleaner would preferably be a standard push-type vacuum cleaner and would include a rechargeable battery which would be externally mounted. The vacuum cleaner would also have a top-mounted light which would face forward and assist a user in vacuuming. The light would be powered by a generator that would produce power when the wheels of the vacuum cleaner are turned.

There has thus been outlined, rather broadly, the more important features of an vacuum cleaner that the detailed description thereof that follows may be better understood and in order that the present contribution to the art may be better appreciated. There are, of course, additional features of the vacuum cleaner that will be described hereinafter and which will form the subject matter of the claims appended hereto.

In this respect, before explaining at least one embodiment of the vacuum cleaner in detail, it is to be understood that the vacuum cleaner is not limited in its application to the details of construction and to the arrangements of the components set forth in the following description or illustrated in the drawings. The vacuum cleaner is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present vacuum cleaner. It is important, therefore, that the claims be regarded as including such equivalent constructions insofar as they do not depart from the spirit and scope of the present invention.

It is therefore an object of the present invention to provide a vacuum cleaner which has all of the advantages of the prior art and none of the disadvantages.

It is another object of the present invention to provide a vacuum cleaner which may be easily and efficiently manufactured and marketed.

It is another object of the present invention to provide a vacuum cleaner which is of durable and reliable construction.

It is yet another object of the present invention to provide a vacuum cleaner which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
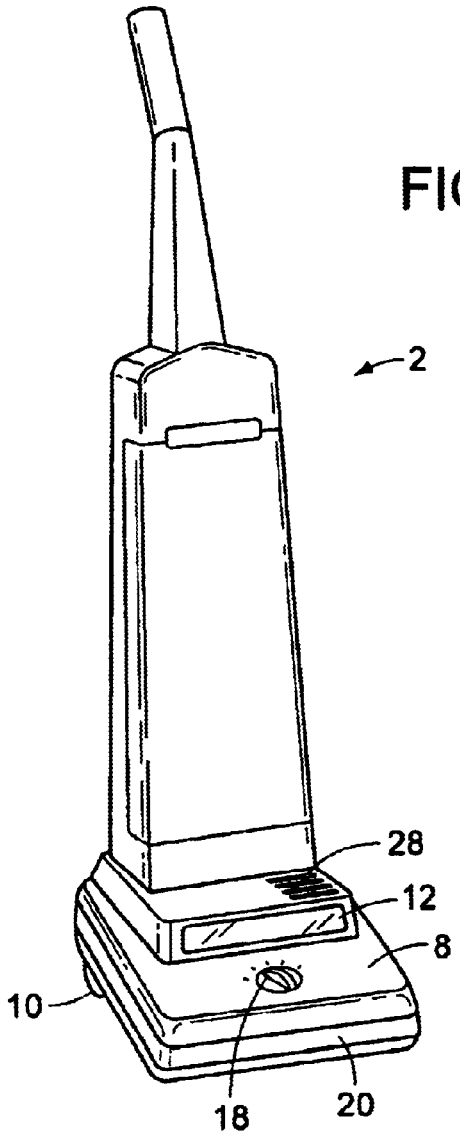
FIG. 1 shows a front view of the present invention.
Figure 2:
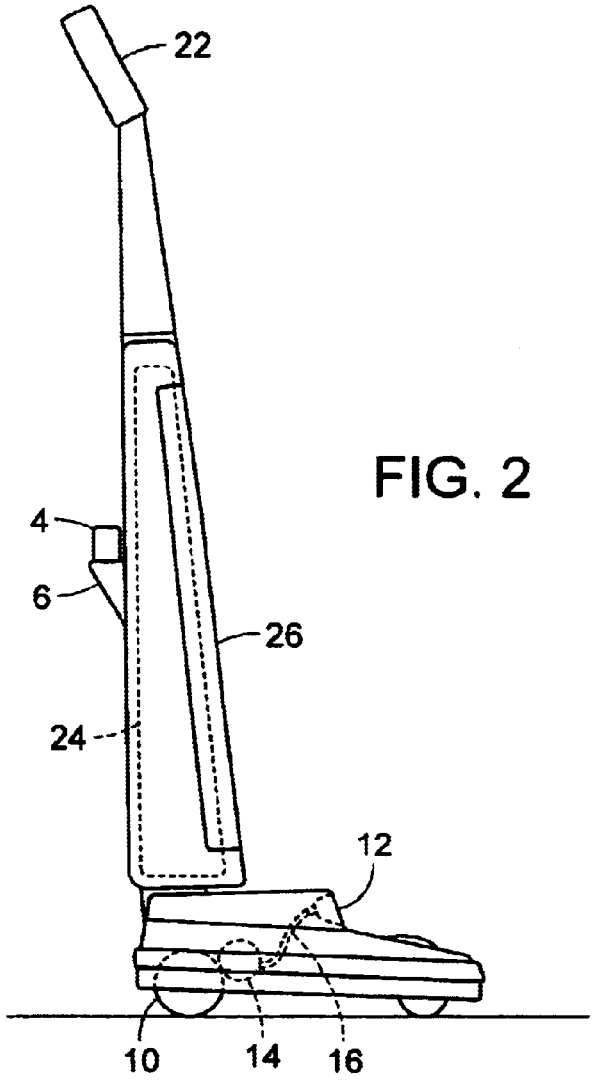
FIG. 2 shows a side view of the present invention.

FIGS. 1 and 2 show front and side views, respectively, of the present invention. The present invention concerns that of a new and improved vacuum cleaner 2 which would be powered solely battery means and/or self-generated power means. The vacuum cleaner 2 would be a standard push-type vacuum cleaner as seen in FIGS. 1 and 2. The vacuum cleaner 2 would include a 24 volt battery 4 as its power means, with the battery 4 being rechargeable when not in use.

The vacuum component 8 would have a plurality of wheels 10 to allow it to be pushed around. The top surface of the vacuum component 8 would also have a top-mounted light 12 which would face forward and assist a user in vacuuming. The light 12 would be powered by a generator 14 that would produce power when the wheels 10 of the vacuum cleaner 2 are turned. Electronic connection 16 would connect the light 2 to the generator 14 to allow the rotational energy that is transferred to the generator 14 by the wheels to subsequently be transferred to light 12.

The vacuum component 8 also has top-mounted height adjustment knob 18, which would allow a user to adjust the height of vacuum component 8 with relation to the floor surface. Further, vacuum component 8 has a front-mounted magnetic strip 20 and top-mounted motor vent 28, which would allow hot air from the internal motor 30 to properly vent.

Handle 22 would be pivotally attached to vacuum component 8 and would include dirt bag 24 and bag holder unit 26, which would affix dirt bag 24 to handle 22. Bag holder unit 26 would comprise a plurality of surfaces, including a front surface and a rear surface. Attached to the rear surface of the bag holder unit 26 would be battery mount 6, with battery 4 being placed on top of battery mount 6.

Figure 3:
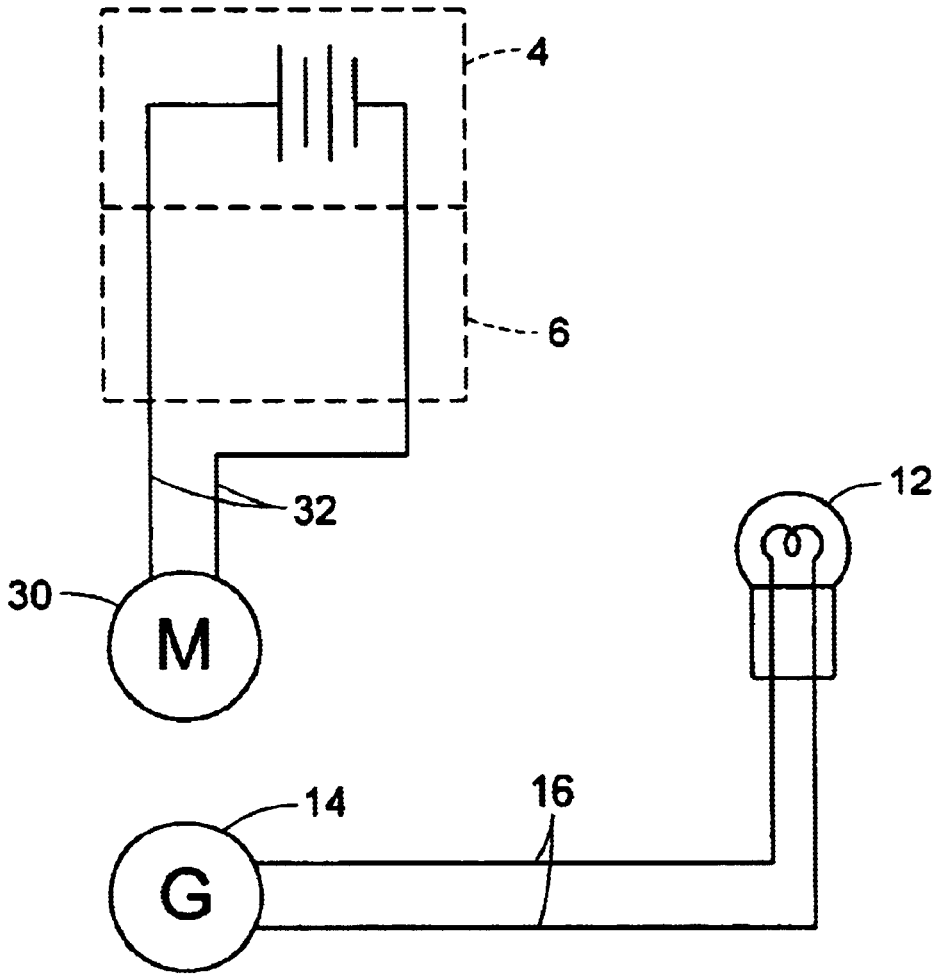
FIG. 3 shows a schematic view of some of the electronics of the present invention.

FIG. 3 shows a schematic view of some of the electronics of the present invention not already shown. Battery 4, atop battery mount 6, is attached to motor 30 via a plurality of wires 32. In addition, light 12 is shown being powered by generator 14 that would produce power when the wheels 10 of the vacuum cleaner 2 are turned. Electronic connection 16 would connect the light 2 to the generator 14 to allow the rotational energy that is transferred to the generator 14 by the wheels to subsequently be transferred to light 12.

What I claim as my invention is:

1. A push-type vacuum cleaner comprising:

(a) a vacuum component, the vacuum component having a top surface and a bottom surface, the bottom surface having a plurality of wheels rotatably attached to the bottom surface, the vacuum component further including a height adjustment knob attached to the top surface, the vacuum component further including an internal motor, (b) a bag holder unit having two ends, a first end and a second end, the first end of the bag holder compartment pivotally attached to the vacuum component, the bag holder unit having a plurality of surfaces comprising a front surface and a rear surface, (c) a dirt collection bag located within the bag holder compartment, (d) a handle attached to the second end of the bag holder compartment, (e) a battery, (f) mounting means for mounting the battery to the rear surface of the bag holder unit, (g) at least one electrical connection between the battery and the internal motor, (h) a light front-mounted on vacuum component, and (i) power means for providing power to the light.

2. A push-type vacuum cleaner according to claim 1 wherein the power means for providing power to the light further comprises:

(a) a generator located within the vacuum component, the generator placed into direct contact with at least one wheel of the plurality of wheels attached to the bottom surface of the vacuum component, (b) an electrical connection between the generator and the light, (c) wherein the rotational energy generated by each wheel in motion while in contact with the generator is transformed by the generator into electrical energy, thereby providing power to the light.

3. A push-type vacuum cleaner according to claim 1 wherein the mounting means for mounting the battery on the top surface of the vacuum compartment further comprises:

(a) a battery mount fixedly attached to the rear surface of the bag holder unit, (b) wherein the battery would be removably placed on the battery mount.

4. A push-type vacuum cleaner according to claim 3 wherein the battery would preferably be a twenty-four volt battery.

5. A push-type vacuum cleaner according to claim 3 wherein the battery would preferably be a rechargeable battery.

* * * * *